United States Patent [19]

Fukuda

[11] 4,242,764

[45] Jan. 6, 1981

[54] HYGIENIC CLEANING APPARATUS

[76] Inventor: Mamoru Fukuda, 1260 Hardy Dr., Bridge City, Tex. 77611

[21] Appl. No.: 944,067

[22] Filed: Sep. 20, 1978

[51] Int. Cl.[3] ..... A47K 13/24; A61H 35/00; E03D 9/08

[52] U.S. Cl. ..... 4/420.4; 4/233; 4/448

[58] Field of Search ..... 4/6, 7, 233, 250, 251, 4/152, 153, DIG. 3

[56] References Cited

U.S. PATENT DOCUMENTS

| | | | |
|---|---|---|---|
| 1,333,073 | 3/1920 | Friedrich | 4/233 |
| 2,957,180 | 10/1960 | McMullen | 4/7 |
| 3,015,826 | 1/1962 | Aranas | 4/7 |
| 4,028,745 | 6/1977 | Caniglia | 4/7 |
| 4,135,255 | 1/1979 | Menendez | 4/7 |

*Primary Examiner*—Frederick R. Schmidt

*Attorney, Agent, or Firm*—Gunn, Lee & Jackson

[57] ABSTRACT

A hygienic cleaning apparatus that provides the washing of the genital area of a person seated on a toilet by upwardly and inwardly directed nozzles, whose water emanations converge at at least one point underneath the area to be cleaned. Temperatures and volume controls and pre-temperature water testing at a test tube outlet are also provided. A warm-air system provides drying air through ducts in the vicinity of the nozzles. The hygienic cleaning apparatus can also be used in conjunction with a modified toilet seat lid, whereby a hole is made at the point where the spray splashes when the lid is in a closed position, the lid containing channels leading away from such opening and terminating in openings over the seat itself, thereby permitting the seat to be washed clean. The warm air system also provides drying air to dry the seat after such washing.

22 Claims, 9 Drawing Figures

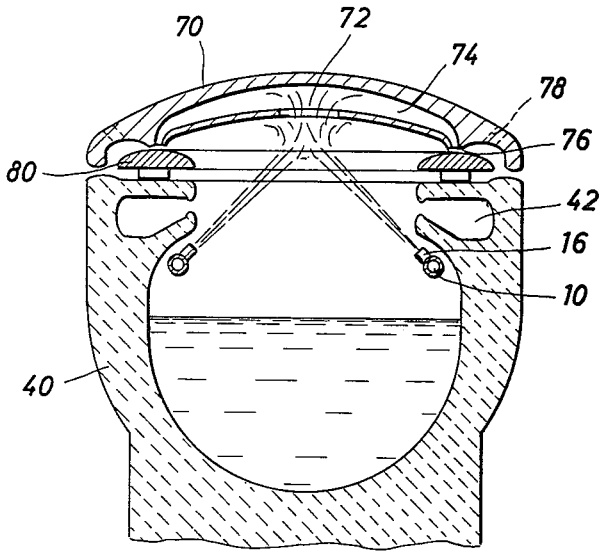
FIG. 7
FIG. 8
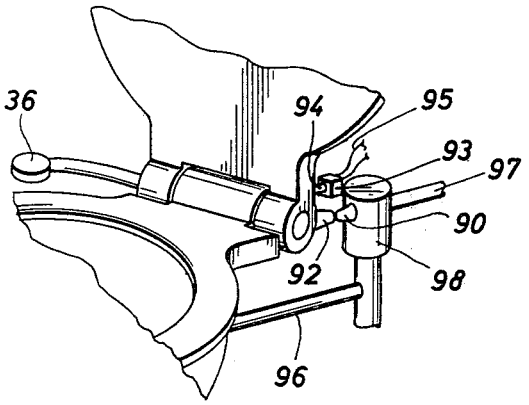
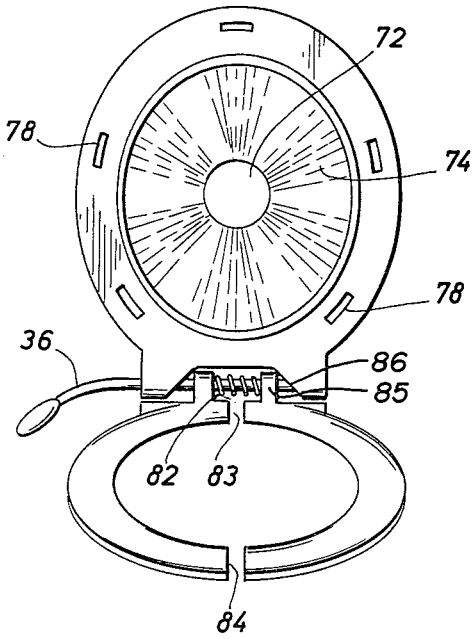
FIG. 9

HYGIENIC CLEANING APPARATUS

BACKGROUND OF THE INVENTION

1. Field of the Invention

This invention relates to hygienic apparatus and more specifically to such apparatus readily installable in combination with a conventional toilet for washing the toilet seat before (or after) use and for cleansing the genital area of a person seated on the toilet.

2. Description of the Prior Art

The conventional method of cleaning oneself after toilet use is with paper, which is not always available, sometimes so rough as to aggravate the skin, and which not infrequently causes plumbing problems by stopping up the toilet at the time of flushing.

Additional hygienic apparatus for washing the genital area has been developed in the form of a bidet which provides a single spout of water and usually is included in a bowl apart from the normal toilet bowl. Such a conventional bidet is expensive, inconvenient for normal washing purposes and often uncomfortable because of improper water temperature or because the spout of water is too strong. On occasion, the spout is not strong enough and there is usually no means of increasing the strength.

Therefore, a feature of the present invention is to provide an improved hygienic apparatus installable in a toilet for washing the genital area of the person with temperature-controlled water flow.

Another feature of the present invention is to provide an improved hygienic apparatus for washing and drying the genital area of a person while seated on a toilet having the invention installed therewith.

Yet another feature of the present invention is to provide an improved hygienic apparatus for washing the genital area of a person seated on a toilet with the invention installed therein, the water being made available for temperature testing by hand prior the water its being used for genital area washing.

Still another feature of the present invention is to provide a toilet with an improved hygienic apparatus for washing the genital area of a person seated on a toilet, which apparatus may also be use for cascading water over the toilet seat before or after use.

Yet another feature of the present invention is to provide a toilet with an improved hygienic apparatus for washing the genital area of a handicapped person incapable of cleansing himself in the conventional manner.

SUMMARY OF THE INVENTION

The invention embodiments disclosed herein include one or more pluralities of nozzles in a water-carrying tube at least partly circumscribing the genital area. The tube is preferably located in the toilet bowl underneath the lip or rim. The water emanating from the nozzles converge at one or more points beneath the genital area and bubbles up to provide the washing. One or more control valves in the cold and hot water source lines provide temperature control. A test outlet is provided to permit hand testing of the water temperature. Air ducts, preferably from a warm-air system, can be located in close proximity to the nozzles for drying the area previously washed. A controlled volume of water and a controlled time for providing air is provided in some of the embodiments.

A lid can be provided for covering the seat and having channels therein leading from a central opening. With such lid closed, the water emanating from the nozzles splashes into the central opening and flows through the channels to be dispensed from outlet openings into the seat, thereby effecting washing. The water from the seat washes into the toilet. The seat can be split in two sections and biased together by a spring, opening of the lid allowing the seat sections to be in their positions of use, the closing of the lid moving the sections together so that the seat washing water does not overflow out of the toilet. The seat can be dried by air ducts through the lid and connected to the warm air system.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

In the Drawings:

FIG. 7 is a pictorial illustration of a preferred embodiment of the invention disclosed herein and including a lid of preferred construction through which the toilet seat is washed before/after use, said picture made vertically from the front.

FIG. 8 is a pictorial illustration of preferred embodiment of the invention illustrating a means of triggering the water source and the air blowing means for drying the toilet seat.

FIG. 9 is a pictorial illustration of a preferred embodiment of the invention illustrating an alternate toilet seat connectable for compression when the lid is closed so that water cascaded over the seat from the channels in the closed lid do not overflow the toilet.

DESCRIPTION OF PREFERRED EMBODIMENT

Figure 1:
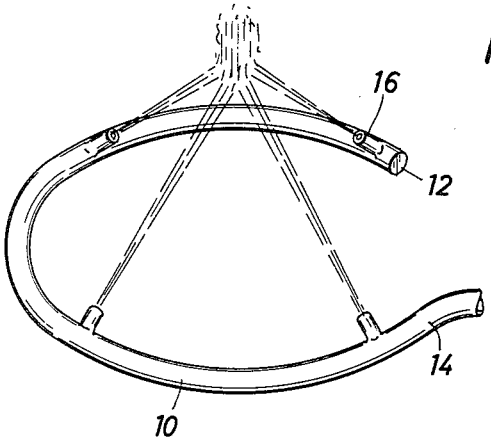
FIG. 1 is a pictorial illustration of a preferred embodiment of the invention disclosed herein.

Now referring to the drawings and first to FIG. 1, an embodiment of the hygienic apparatus in accordance with the present invention is illustrated. A tube 10 shaped in a configuration so as to at least partly circumscribe the genital area of the person seated on the toilet has one end 12 capped or otherwise sealed and the other end 14 adaptable for the receipt of cleaning water. Typically the tube is a chromed copper tube, but other materials, such as plastic PVC, may be used. As is more evident in FIGS. 5 and 6, the tube is preferably fitted underneath the rim of the toilet bowl when installed in a position of use.

A plurality of nozzles 16 are spaced along tube 10, each of the nozzles being directed inwardly and upwardly. Four nozzles are illustrated; however, in any particular installation a lesser or a greater number may be used. In any event, water jets emanating from the respective nozzles under operating pressure converge at a point underneath the genital area of the person seated on the toilet. The converging streams act on each other so that there is an upward or vertical bubbling of a combined stream to wash and clean the genital area. Actually, there is also a little overshoot at the converging point so that the result is a spreading vertical bubbling that provides a gentle washing of the genital area.

Figure 2:
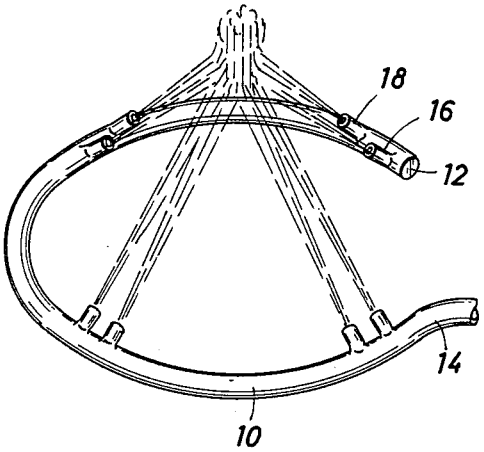
FIG. 2 is a pictorial illustration of an alternate preferred embodiment of the invention disclosed herein.

FIG. 2 illustrates an alternate embodiment to that shown in FIG. 1. Tube 10 includes a plurality of nozzles 16. But, in addition, a second plurality of nozzles 18 are spaced about tube 10, these nozzles also being inwardly and upwardly directed. In this case, the converging point is vertically underneath the converging point for the first plurality of nozzles. In operation, the water bubbling up from the convergence of the water streams from the second plurality of nozzles combines with the water bubbling up from the convergence of the water streams from the first plurality of nozzles to provide a composite washing action.

Figure 3:
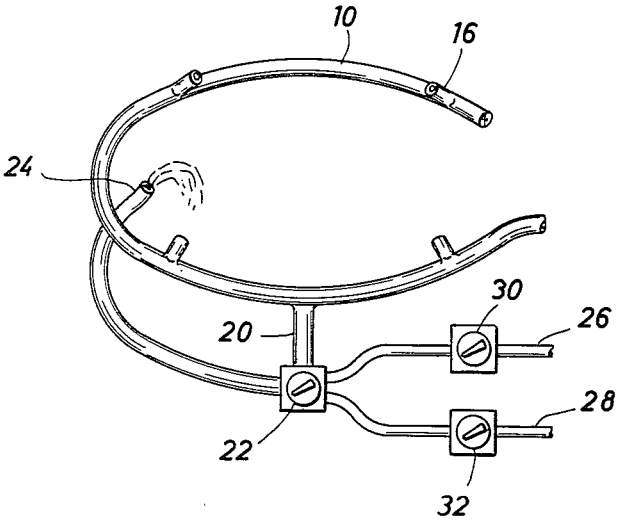
FIG. 3 is a pictorial illustration of a preferred embodiment of the invention showing one means for controlling the temperature of the water used therewith.

FIG. 3 shows a tube 10 with nozzles 16 having both ends capped or otherwise sealed and an injection tube 20 connected thereto. Injection tube 20 receives its input of water through a water connection means including a flow direction valve 22. The alternate position of valve 22 directs the input flow of water to a test tube 24, the outlet end of which is located for ready access to the hand of the person sitting on the toilet.

Two input tubes 26 and 28 provide connection to cold and hot sources of water, tube 26 being connected to the cold water source and tube 28 being connected to the hot water source. Flow control valve 30 is located in tube 26 to provide means for adjusting the flow of water therethrough and flow control valve 32 is located in tube 28 to provide means for adjusting the flow of water through tube 28. These valves provide an effective means of determining the temperature of the combined flow from these two tubes, first for testing at the outlet of test tube 24 and, upon the repositioning of valve 22, for directing the water through injection tube 20.

To minimize the force with which the water flows from test tube 24, this tube is made so as to have a much larger diameter than injection tube 20, tube 10 or nozzles 16.

Figure 4:
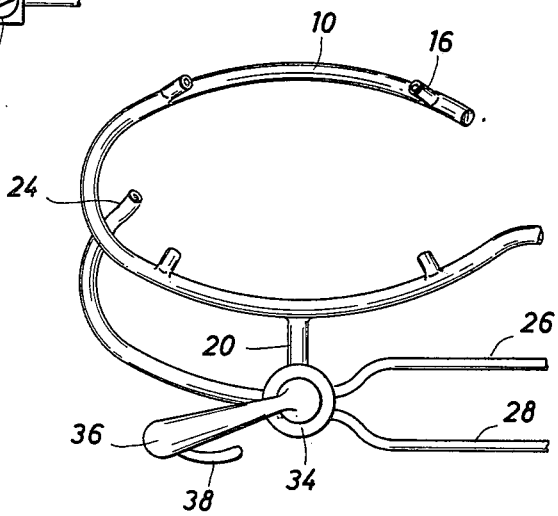
FIG. 4 is a pictorial illustration of another preferred embodiment of the invention showing another means for controlling the temperature of the water used therewith.

FIG. 4 illustrates an alternate system of flow control to that shown in FIG. 3. In this embodiment, individual flow control valves are not included in tubes 26 and 28. Instead, these tubes are connected to a single-handle faucet unit 34, also connected to test tube 24 and injection tube 20, as with the FIG. 3 embodiment. Handle 36 provides the operating means of selecting between the amount of flow from tube 26 compared with the amount of flow from tube 28 and, with an outward rotation of the handle, the total amount of flow. An additional handle 38 provides the means for selecting the output flow to be directed to test nozzle 24 or injection tube 20.

Figure 5:
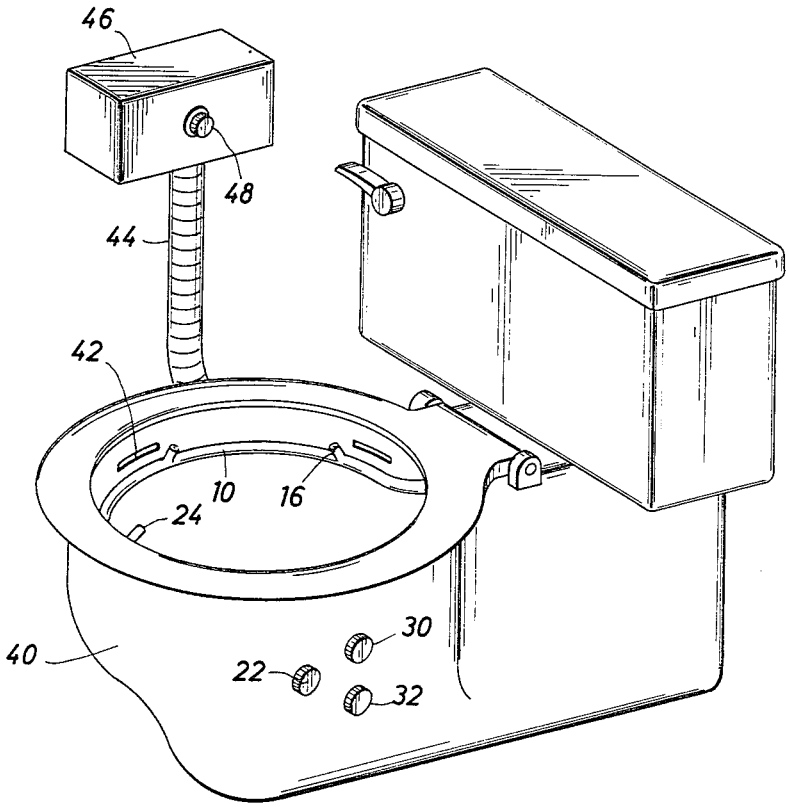
FIG. 5 is a pictorial illustration of a preferred embodiment of the invention illustrated in conjunction with a typical toilet installation.

FIG. 5 illustrates a typical installation of the arrangement shown in FIG. 3 as it would appear installed in a toilet 40. Tube 10 is installed sufficiently underneath the rim or lip of the bowl of the toilet seat so that the nozzles are shielded from urination. Controls 22, 30 and 32 are made accessible along the side of the toilet.

Also illustrated in FIG. 5 is an air blowing system having a plurality of ducts located with their outputs just over tube 10, the passage of air from the ducts 42 being directed so as to dry the genital area of the person seated on the toilet previously washed. The input of these ducts is through a master duct 44 connected to a hot air blowing unit 46. In operation, the blowing unit is operated by switch 48, which includes a timer, to provide heated air for a predetermined time through ducts 42, automatically shutting off at the expiration of that time.

Figure 6:
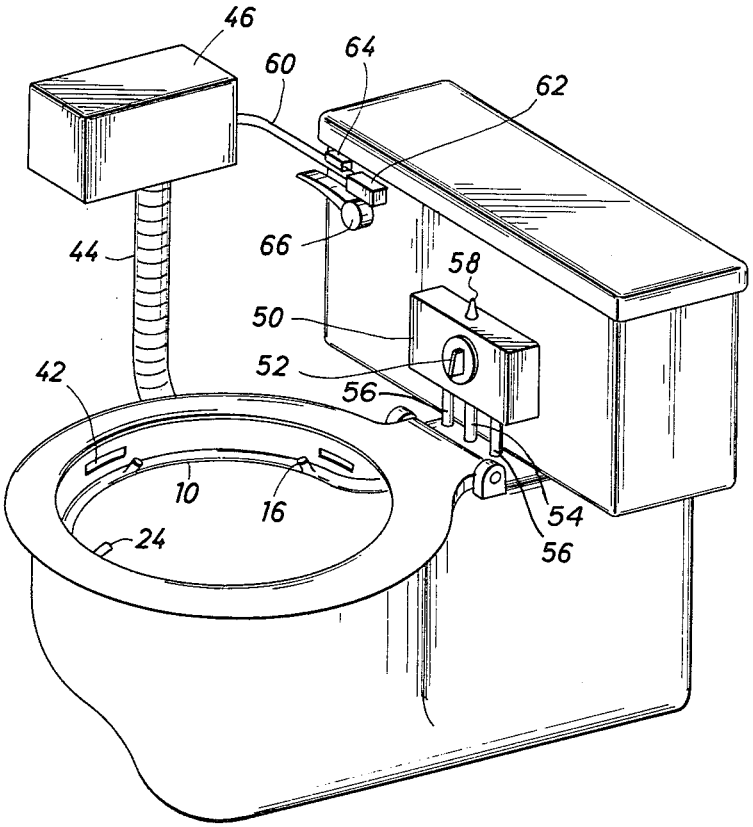
FIG. 6 is a pictorial illustration of another preferred embodiment of the invention illustrated in conjunction with a typical toilet installation.

FIG. 6 illustrates a system by which tube 10 receives its input flow of water from hot water dispenser 50. Dispenser 50 includes a control 52 for thermostatically setting the temperature at which water is dispensed from the dispenser. Typically, the dispenser includes a storage reservoir and a heater, the temperature in the reservoir being maintained as determined by the setting of control 52. Electrical connection is made via lines 54 and water connection is made via tube(s) 56. Plunger 58 provides the means for releasing or dispensing a predetermined volume of water from the dispenser.

The FIG. 6 embodiment also includes an air blowing apparatus. Ducts 42 located in the toilet receive warm air from master duct 44 as determined by hot air blowing unit 46. Connection 60 to a microswitch 62 provides the means for activating the air blowing unit. Line 60 also includes a time delay mechanism 64. In operation, when the microswitch is activated, the time delay mechanism is activated so that air is blown by the air blowing unit after a predetermined time. As with the FIG. 5 embodiment, air shuts off automatically after a predetermined period of time.

The operations of plunger 58 and microswitch 62 are preferably made by toilet handle 66. Following the flushing of the toilet in the conventional manner, handle 66 is rotated past the microswitch to start the delay timing action just described and then to plunger 58, to discharge the predetermined amount of water.

Alternately, the dispenser can be made to dispense a continuous flow so long as the handle depresses plunger 58 and the microswitch is operated on the return rotation of handle 66.

Now referring to FIG. 7, an embodiment of the present invention is shown which includes a lid 70 that provides washing of toilet seat 80 when the lid is closed. As is shown toilet 40 has installed therein a plurality of nozzles 16 for creating an upward combined stream. Lid 70 includes a central opening 72 located over such stream and has included therein a plurality of downward sloping channels 74 terminating in outlet openings 76 in close proximity to the top surface of seat 80. As is illustrated in FIG. 9, there are six channels fanning out to provide a complete coverage. The individual outlet openings preferably merge into a single arcuate opening for providing overall washing coverage. However, a lesser number of channels can be provided, if desired.

In operation, the combined water spout flows downwardly through the lid channels and emanates from the outlet openings to cascade over the seat into the toilet bowl to thereby effect washing.

Air ducts 78 are provided through the lid also having outlet openings in the proximity of the seat to effect drying from the same warm air system previously described, as more fully expanded hereinafter.

Now turning to FIG. 8, actuating means in the form of knob 90 is connected to a water source (not shown). The knob is mounted to actuate valve 98 to permit flow from the source through conduit 97 to conduit 96 to the nozzles. A microswitch 93 is connected via leads 95 for actuating the warm air system. Projection 92 is provided for actuating knob 90 and projection 94 is provided for actuating microswitch 93. These projections are connected to the extension of handle 36 onto which lid 70 and seat 80 are mounted. The fit of lid 70 with respect to handle 36 is sufficiently close such that when the lid is closed the projections rotate upwardly to actuate knob 90 and to close microswitch 93. A spring or other biasing means (not shown) may be connected to the handle extension to rotate the knobs downward after the lid has been closed for a moment. Handle 36, of course, provides the means to rotate the knobs upward to contact knob 90 and switch 93 independent of lifting the lid, if desired.

In operation, the actuating of knob 90 supplies water for washing the seat for a predetermined period of time and the closing of microswitch 93 actuates a time delay switch that causes the warm air system to blow drying air through air ducts 78 after the conclusion of the water washing period for a second predetermined length of time.

Now referring to FIG. 9, an arrangement of a seat is shown having two complementary sections separated both at a back opening 83 and at a front opening 84. The handle extension to which the seat is connected has a compression spring 82 wound thereover for maintaining the separation of the sections in the position of use. Near the rear of each section is an external edge 85 that contact an inwardly sloping edge 86 on the lid. When the lid is up, openings 83 and 84 are fully expanded. When the lid is closed the tapering of the sloping edge against straight edge 85 causes the compression spring to be compressed and to reduce openings 83 and 84. This minimizes the risk that the cascading water over the toilet seat will overflow from the toilet.

From the discussion of FIGS. 7–9 it is apparent that the lid arrangement for providing washing and drying of the toilet seat does not interfere with the hygienic cleansing function of the components described with respect to FIGS. 1–6. The alternate structures discussed with respect thereto can equally functionally operate with such lid arrangement.

While particular embodiments of the invention have been shown, it will be understood that the invention is not limited thereto, since many modifications may be made and will become apparent to those skilled in the art.

What is claimed is:

1. In combination with a toilet having an overhanging lip affixed to a water holding bowl, hygienic cleaning apparatus for washing the genital area of a person sitting thereover, comprising a tube having an inlet for receiving water under pressure, said tube being adapted to be located in the bowl extending along the lip thereof with said tube being located beneath and at least partly circumscribing the genital area; and a plurality of nozzles connected to said tube and spaced apart from each other, said nozzles being directed upwardly and angularly inwardly so that water streams emanating under pressure from said nozzles converge at a point below the genital area to form a further upward combined stream that contacts the genital area.

2. Hygienic cleaning apparatus in accordance with claim 1 wherein said tube is formed into a curved tube having a horseshoe shape;

said nozzles are sufficiently located underneath the lip of the bowl of the toilet so as to shield them from urination; and said plurality of nozzles are angularly spaced relative to the bowl such that one such nozzle is symmetrically located on one side of a centerline through the bowl and directs a stream of water to intersect a stream of water from a symmetrically located second nozzle in said plurality and said two nozzles cooperatively direct the streams of water from said tube wholly within or above the bowl.

3. Hygienic cleaning apparatus in accordance with claim 2, and including a second plurality of nozzles connected to said tube and spaced apart from each other, said nozzles being directed upwardly and inwardly so that water emanating under pressure from said second plurality of nozzles converge beneath the point of convergence caused by said first-named nozzles to form an upward combined stream that merges with said first-named upward combined stream prior to contact with the genital area.

4. Hygienic cleaning apparatus in accordance with claim 2, and including water connection means connected to said tube including adjustable temperature control means for determining the temperature at which the water emanating from said nozzles is delivered, and a test nozzle connected to said water connection means for allowing the person to comfort test the temperature determined by said water connection means prior to being applied to said plurality of nozzles.

5. Hygienic cleaning apparatus in accordance with claim 4, wherein said adjustable temperature control means includes a flow direction valve for alternately applying water input to said test nozzle and said plurality of nozzles.

6. Hygienic cleaning apparatus in accordance with claim 4, wherein said water connection means includes a first input tube to a cold water source and a second input tube to a hot water source, and wherein said adjustable control means includes a first volume-limiting valve for regulating the volume of flow through said first input tube and a second volume-limiting valve for regulating the volume of flow through said second input tube.

7. Hygienic cleaning apparatus in accordance with claim 4, wherein said water connection means includes a first input tube to a cold water source and a second input tube to a hot water source, and wherein said adjustable control means includes a valve connected to said first and second input tubes for proportionately selecting between the flow of water from said first and second input tubes.

8. Hygienic cleaning apparatus in accordance with claim 7, wherein said valve of said adjustable control means includes total volume means.

9. In combination with a toilet, apparatus for cleaning the toilet seat and for washing the genital area of a person sitting thereon, comprising a tube having an inlet for receiving water under pressure, said tube being located beneath and at least partly circumscribing the genital area of a person sitting on the seat, a plurality of nozzles connected to said tubing and spaced apart from each other, said nozzles being directed upwardly and inwardly so that water emanating under pressure from said nozzles converge to form a further upward combined stream that contacts the genital area, and a lid for covering the toilet seat and having at least one downwardly sloping water conducting channel formed along a portion of said lid, said channel extending from a central opening in said lid located over the combined stream and terminating at an outlet opening, said channel receiving water from the upward combined stream through said central opening when said lid is closed, said channel dispensing water through at least one outlet opening onto said toilet seat to clean said seat by flowing at least partly thereacross and including means confining flow across said seat into a bowl below said seat.

10. Apparatus in accordance with claim 9, wherein said lid includes at least an additional channel having an outlet opening in the proximity of the seat, and including air blowing means connected to the inlet of said additional channel for injecting drying air to the seat.

11. Apparatus in accordance with claim 10, wherein said air blowing means includes means for pre-heating the air prior to its injection.

12. Apparatus in accordance with claim 9, and including a water source connected to said tube and having release means, and a projection on said lid for actuating said release means upon closing of said lid.

13. Apparatus in accordance with claim 12, wherein said lid includes at least an additional channel having an outlet opening in the proximity of the seat, said apparatus including air blowing means connected to the inlet of said additional channel for injecting drying air to the seat, a water source connected to said tube and having release means, said air blowing means including a delay release means, said lid including projection means operably connected thereto for actuating said release means and said delay release means upon closing of said lid, said water source being actuated for a first predetermined time upon actuation of said release means, said air blowing means being actuated following said first predetermined time for a second predetermined time upon actuation of said delay release means.

14. Apparatus in accordance with claim 13, wherein said delay release means includes a microswitch and timing means.

15. Apparatus in accordance with claim 13, an including a handle connected to said projection means for operating said release means and said delay release means independent of said lid.

16. Apparatus in accordance with claim 9, wherein said toilet includes a seat with a first section and a second section, said first and second sections being complementary and slightly separated when said lid is not closed, spring bias means connected to said first and second sections, and compression means at least partially operably connected to said lid for compressing said spring bias means when said lid is closed, thereby moving said first and second sections toward each other to permit water washing the seat to run into the toilet without overflowing.

17. In combination with a toilet, hygienic cleaning apparatus for washing the genital area of a person sitting thereover, comprising a tube having an inlet for receiving water under pressure, said tube being located beneath and at least partly circumscribing the genital area;

a plurality of nozzles connected to said tubing and spaced apart from each other, said nozzles being directed upwardly and inwardly so that water emanating under pressure from said nozzles converge to form a further upward combined stream that contacts the genital area;

air blowing means comprising at least one air duct located for directing air to the genital area; and a second plurality of nozzles connected to said tube and spaced apart from each other, said second plurality of nozzles being directed upwardly and inwardly so that water emanating under pressure from said second plurality of nozzles converge beneath the point of convergence caused by said first named nozzles to form an upward combined stream which merges with said first named upward combined stream prior to contact with the genital area.

18. Hygienic cleaning apparatus in accordance with claim 17, wherein said air blowing means includes means for preheating air prior to its injection through said duct.

19. In combination with a toilet having a flush handle, hygienic cleaning apparatus for washing the genital area of a person sitting thereover, comprising a tube having an inlet for receiving water under pressure, said tube being located beneath and at least partly circumscribing the genital area;

a plurality of nozzles connected to said tubing and spaced apart from each other, said nozzles being directed upwardly and inwardly so that water emanating under pressure from said nozzles converge to form a further upward combined stream that contacts the genital area; and water dispensing means connected to said tube, said dispensing means including thermostatically adjusting means for adjustably determining the temperature of water from said dispensing means; and release means for allowing a predetermined volume of water to be dispensed from said dispensing means.

20. Hygienic cleaning apparatus in accordance with claim 19, and including air blowing means comprising at least one air duct located for directing air to the genital area, said blowing means including time delay switch means for providing air through said duct at a predetermined time following the dispensing of water from said dispensing means.

21. Hygienic cleaning apparatus in accordance with claim 20, wherein said air blowing means includes means for preheating air prior to its injection through said duct.

22. Hygienic cleaning apparatus in accordance with claim 20, wherein said release means of said water dispensing means and said time delay switch means of said blowing means are activated by operation of the flush handle of the toilet.

* * * * *